US007722210B2

(12) United States Patent
Tessnow et al.

(10) Patent No.: US 7,722,210 B2
(45) Date of Patent: May 25, 2010

(54) AUTOMOTIVE LAMP AND REFLECTOR FOR LOW BEAM AND ADVANCED FORWARD LIGHTING SYSTEM

(75) Inventors: Thomas Tessnow, Weare, NH (US); Joseph C. Swadel, Salem, NH (US); Daniel D. Devir, South Sutton, NH (US); Richard D. Holland, Stoddard, NH (US); Edward P. Otto, Henniker, NH (US); Michael Tucker, Henniker, NH (US)

(73) Assignee: OSRAM SYLVANIA Inc., Danvers, MA (US)

( * ) Notice: Subject to any disclaimer, the term of this patent is extended or adjusted under 35 U.S.C. 154(b) by 17 days.

(21) Appl. No.: 12/217,220

(22) Filed: Jul. 2, 2008

(65) Prior Publication Data

US 2010/0002458 A1 Jan. 7, 2010

(51) Int. Cl.
*F21K 2/00* (2006.01)
*H01K 9/08* (2006.01)

(52) U.S. Cl. ..... 362/211; 362/215; 313/316; 313/272

(58) Field of Classification Search ..... 362/211, 362/212, 516, 464, 518, 215; 313/316, 317, 313/318.11, 115, 113
See application file for complete search history.

(56) References Cited

U.S. PATENT DOCUMENTS

| | | | | |
|---|---|---|---|---|
| 4,644,452 | A * | 2/1987 | Kasboske | 362/214 |
| 5,725,298 | A * | 3/1998 | Kalze et al. | 362/214 |
| 6,709,130 | B2 * | 3/2004 | Behr et al. | 362/214 |
| 6,822,392 | B2 * | 11/2004 | Behr et al. | 313/578 |

* cited by examiner

*Primary Examiner*—Ali Alavi
(74) *Attorney, Agent, or Firm*—Edward S. Podszus

(57) ABSTRACT

An advanced forward lighting system may be made with a lamp having a first filament and a second filament extending perpendicular to the first filament. The second filament is partially hidden rearward and above the first filament. A reflector forms a main beam from the first filament light and a right or left cast supplemental beam from the second filament light. The second filament's position minimizes glare, and enables a simple advanced forward lighting system from a single standard lamp fitting both right and left side reflectors.

23 Claims, 14 Drawing Sheets

| COIL | BODY LENGTH [mm] | DIAMETER [mm] | VOLTAGE [V] | POWER [W] | FLUX [lm] |
|---|---|---|---|---|---|
| AFS | 3.0 TO 5.0 | 1.0 TO 2.5 | 12.8 | 30 TO 40 | 500 |
| LOW BEAM | 4.67 | 1.49 TO 1.7 | 12.8 | 55 | 1000 |

FIG. 6

AUTOMOTIVE LAMP AND REFLECTOR FOR LOW BEAM AND ADVANCED FORWARD LIGHTING SYSTEM

CROSS-REFERENCE TO RELATED APPLICATIONS

Background of the Invention

1. Field of the Invention

The invention relates to electric lamps and particularly to electric lamps. More particularly the invention is concerned with automotive lamps with multiple filaments for headlamp lighting.

2. Description of the Related Art Including Information Disclosed Under 37 CFR 1.97 and 1.98

Advanced forward lighting systems (AFS) for vehicles provide additional light to the turning side of a vehicle. Mechanical systems that turn the whole headlamp or the reflector to the right or left are mechanically complex and subject to wear failure. An alternative is to incorporate multiple filaments in a single incandescent lamp. By selectively illuminating supplementary filaments, the turning illumination may be provided at modest cost increase. Multiple lamps forming one beam, or multiple filaments in one lamp commonly have supports that intersect the light from the alternative source leading to glare production, suggesting a single filament on a relevant side for the supplementary light. Maintaining two lamp types, right and left, is expensive, and could lead to incorrectly installed lamps. The right and left lamps may be keyed to prevent incorrect installation, but the cost of maintaining both right and left lamp supplies is troublesome. There is then a need for an AFS incandescent type lamp with a minimum of filaments, and makes the need for both left and right supplies unnecessary.

BRIEF SUMMARY OF THE INVENTION

A single automotive lamp and reflector assembly may be formed to enable an automotive headlamp providing both a low beam and advanced forward lighting features. The automotive lamp includes a light transmissive envelope defining a lamp axis extending positively in a forward direction and negatively in a rearward direction. The envelope also defines an enclosed volume. The envelope has a seal at a rear end of the envelope. A first filament is located in the enclosed volume and has a first filament axis that extends generally in the lamp axis direction. The first filament has a front leg extending at a forward end of the first filament, and a rear leg extending at a rear end of the first filament. The lamp also includes a second filament located in the enclosed volume and that extends in a second filament direction that is perpendicular to the lamp axis and in a plane parallel to but offset from the lamp axis. The second filament coil is positioned rearward of the rearward most portion of the first filament coil. The second filament has first leg extending at a left end of the second filament, and a second leg extending at a right end of the second filament. A first electrically conductive lead extending through the seal and electrically couples to and mechanically supports the front leg of the first filament. A second electrically conductive lead extends through the seal and electrically couples to and mechanically supports the rear leg of the first filament. A third electrically conductive lead may optionally be used that extends through the seal and electrically couples to and mechanically supports the left leg of the second filament. A fourth, (the third if the optional third lead is not used) electrically conductive lead extends through the seal and electrically couples to and mechanically supports the right leg of the second filament. A concave reflector is positioned generally axially rearward of the automotive lamp. The reflector has a concave reflective surface, with at least one reflective first section defining at least one first focal point located adjacent to or within the convex volume defined by the first filament. The reflective first section is optically defined to project light from the first filament in a forward direction as an automotive forward beam pattern, such as a low beam pattern. The reflector also has at least one reflective second section defining at least one second focal point located adjacent to or within the convex volume defined by the second filament. The reflective second section is optically defined to project light from the second filament in a direction that is horizontal and to a side (right or left) of the forward direction when the lamp axis is horizontal and the second filament axis is horizontal.

BRIEF DESCRIPTION OF THE SEVERAL VIEWS OF THE DRAWINGS

FIG. 6 shows a table of dimensions for the preferred embodiment of the filaments for the automotive lamp.

DETAILED DESCRIPTION OF THE INVENTION

Figure 1:
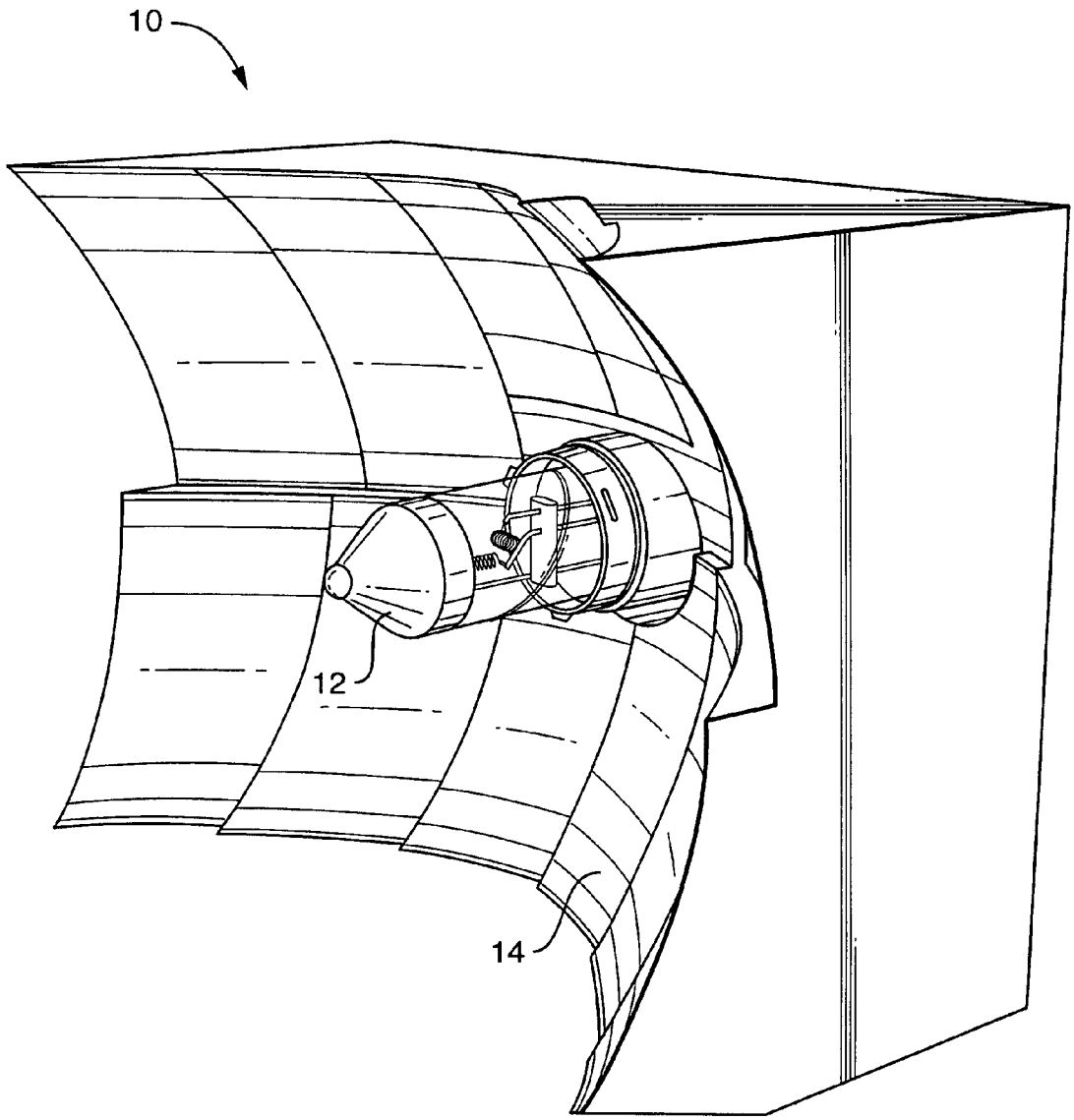
FIG. 1 shows a perspective view of a preferred embodiment of an automotive lamp and reflector for low beam and advanced forward lighting system.

FIG. 1 shows an automotive lamp and reflector assembly 10 for low beam and advanced forward lighting system having an automotive lamp 12 and an automotive reflector 14.

Figure 2:
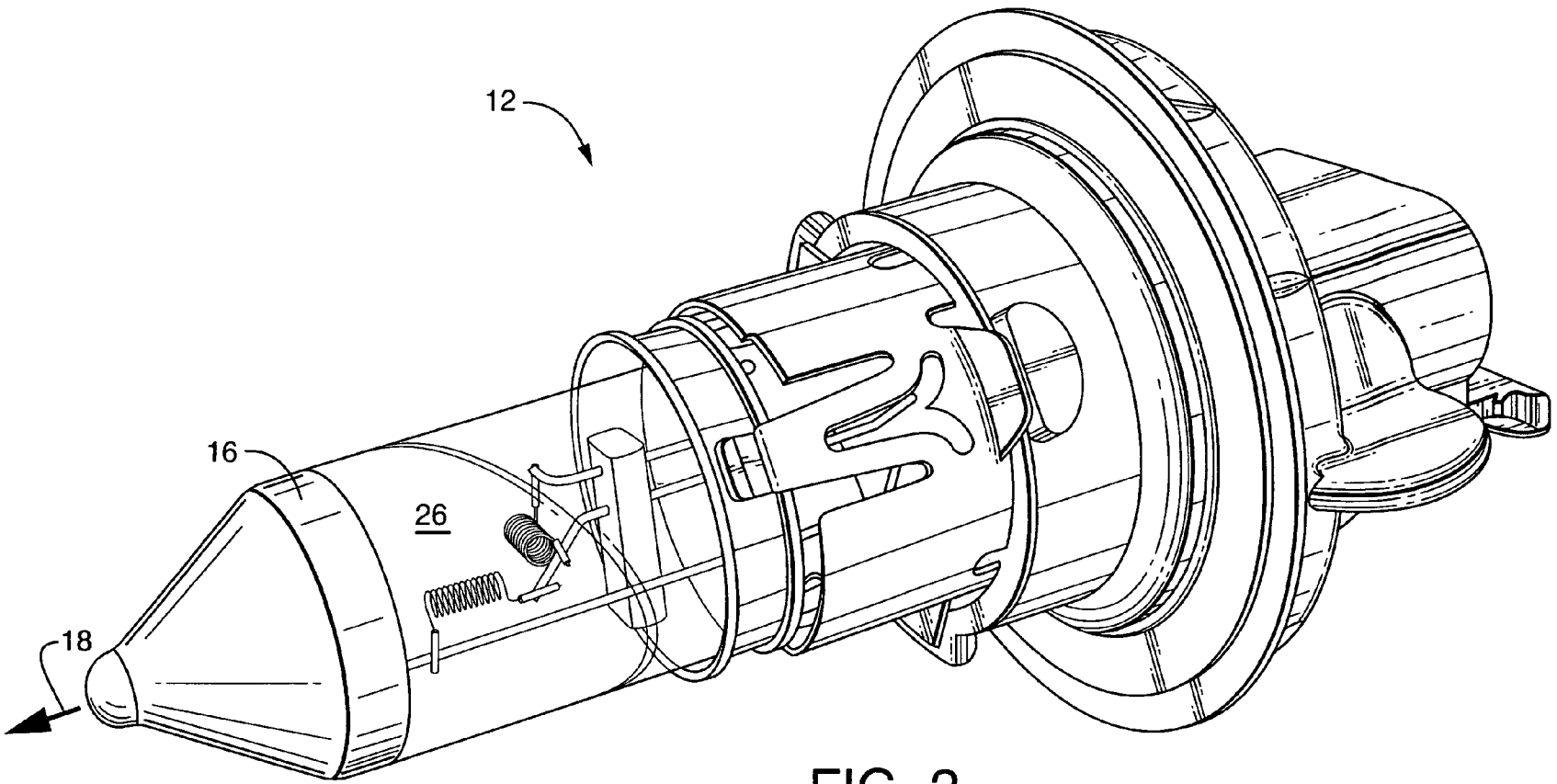
FIG. 2 shows a preferred embodiment of an automotive lamp.

FIG. 2 shows a preferred embodiment of an automotive lamp. The lamp 12 has an envelope 16 defining a lamp axis 18 extending positively in a forward direction and negatively in a rearward direction. The lamp envelope 16 has a wall defining an enclosed volume 20. The envelope 16 has a seal 22 at a rear end of the envelope 16.

Figure 3:
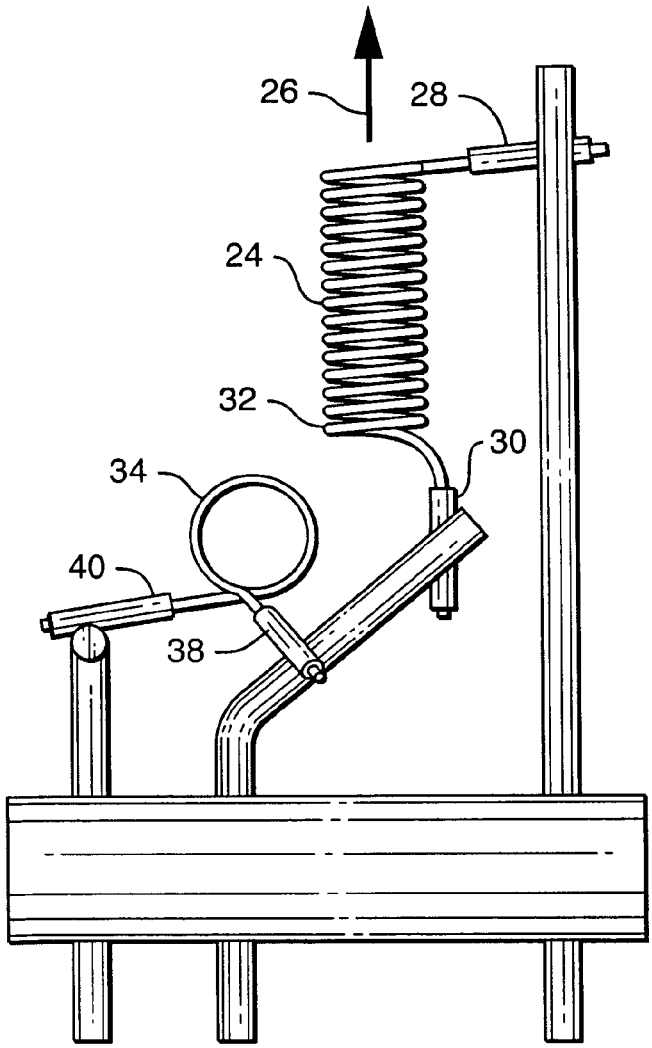
FIG. 3 shows a side view of preferred embodiment of the filament arrangement for the automotive lamp.
Figure 4:
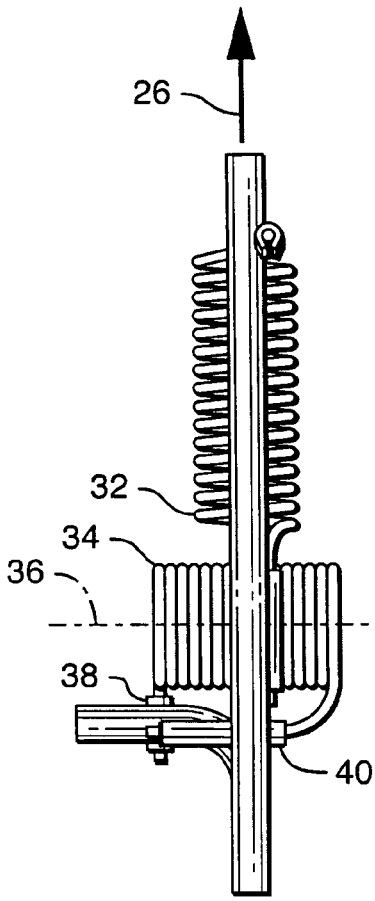
FIG. 4 shows a bottom view of preferred embodiment of the filament arrangement for the automotive lamp.
Figure 5:
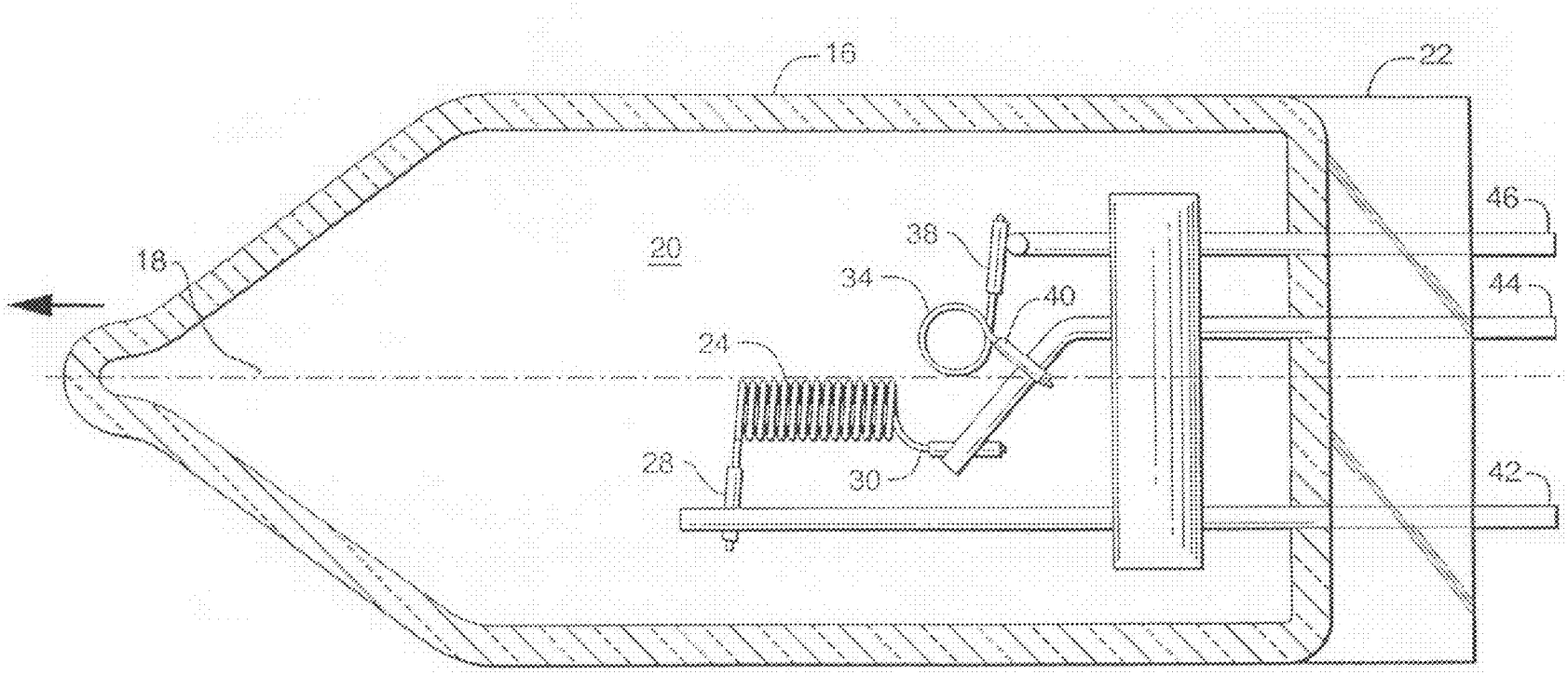
FIG. 5 shows a side view of preferred embodiment of a lamp capsule with the filament arrangement for the automotive lamp.

FIG. 3 shows a side view of preferred embodiment of the filament arrangement for the automotive lamp. FIG. 4 shows a bottom view of preferred embodiment of the filament arrangement for the automotive lamp. FIG. 5 shows a side view of preferred embodiment of a lamp capsule with the filament arrangement for the automotive lamp. FIG. 6 shows a table of dimensions for the preferred embodiment of the filaments for the automotive lamp. The lamp 12 has in the volume 20 encloses a first filament 24 that is preferably a cylindrically coiled wire that has a first filament axis 26 extending in the lamp axis 18 direction. The first filament 24 has a front leg 28 extending at a forward end of the first filament 24, and has a rear leg 30 extending at a rear end 32 of the first filament 24. In a preferred embodiment, the central lamp axis 18 is tangent to a side of the first filament 24 (FIG. 5).

The lamp 12 has a second filament 34, preferably a cylindrically coiled wire, located in the enclosed volume 20 and extending in a second filament axis 36 direction that is perpendicular to the lamp axis 18 in a plane parallel to but offset from the lamp axis 18. The second filament 34 is positioned so its coiled portion is rearward of rearward most portion 32 of the coiled portion of the first filament 24. From this position, light from the second filament 24 that strikes the first reflective zones of the reflector can be directed downward into the foreground, and therefore not interfere with down the road illumination. The second filament 34 has first leg 38 extending at a left end of the second filament 34, and a second leg 40 extending at a right end of the second filament 34. In a preferred embodiment, the second filament 34 has equal axial extensions with respect to the second filament axis 36 on both sides of a vertical plane through the first filament axis 26 when the lamp axis 18 is horizontal and the second filament axis 36 is horizontal. With the second filament 34 equally extended on either side of the vertical plane through the low beam filament, the filament structure is symmetric and may be used in with either right or left side reflectors. In other words, the same purchased lamp may be installed in either a right side or left side reflector. The reflectors however need not be symmetric, and are not anticipated to be symmetric as the light control needed to the side of a vehicle adjacent the oncoming traffic is different from the light control needed to the side of a vehicle away from the oncoming traffic. The axial extension of the second filament may be varied according to how much or how little light is desired to be projected to the side. In a preferred embodiment, the lamp axis 18 is tangent to a side of the second filament 34.

The automotive lamp 12 has a first electrically conductive lead 42 extending through the seal 22 and is electrically coupled to and mechanically supports the front leg 28 of the first filament 24. In a preferred embodiment, the first electrically conductive lead 42 parallels a side of the first filament 24.

The automotive lamp 12 has a second electrically conductive lead 44 extending through the seal 22 and is electrically coupled to and mechanically supports the rear leg 30 of the first filament 24. The preferred second electrically conductive lead 44 is also electrically coupled to and mechanically supports the second leg 40 of the second filament 34. In a preferred embodiment, the whole of the second electrically conductive lead 44 is rearward of the coiled portion of the first filament 24 and is above and/or rearward of the coiled portion of the second filament 34, when the lamp axis 18 is horizontal and the second filament 34 axis is horizontal. In a less preferred embodiment, the function of the second electrically conductive lead 44 can be divided between two leads, one lead connecting the leg 30, and a second lead connecting leg 40.

The lamp 12 may have a third electrically conductive lead 46 extending through the seal 22. The third electrically conductive lead 46 is electrically coupled to and mechanically supports the first leg 38 of the second filament 34. In a preferred embodiment, the whole of the third electrically conductive lead 46 is above and rearward of the coiled portion of the first filament 24 and is above and rearward of the coiled portion of the second filament 34, when the lamp axis 18 is horizontal and the second filament 34 axis is horizontal. FIG. 6 shows a table of the preferred dimensions of the filaments 24 and 34.

Figure 7:
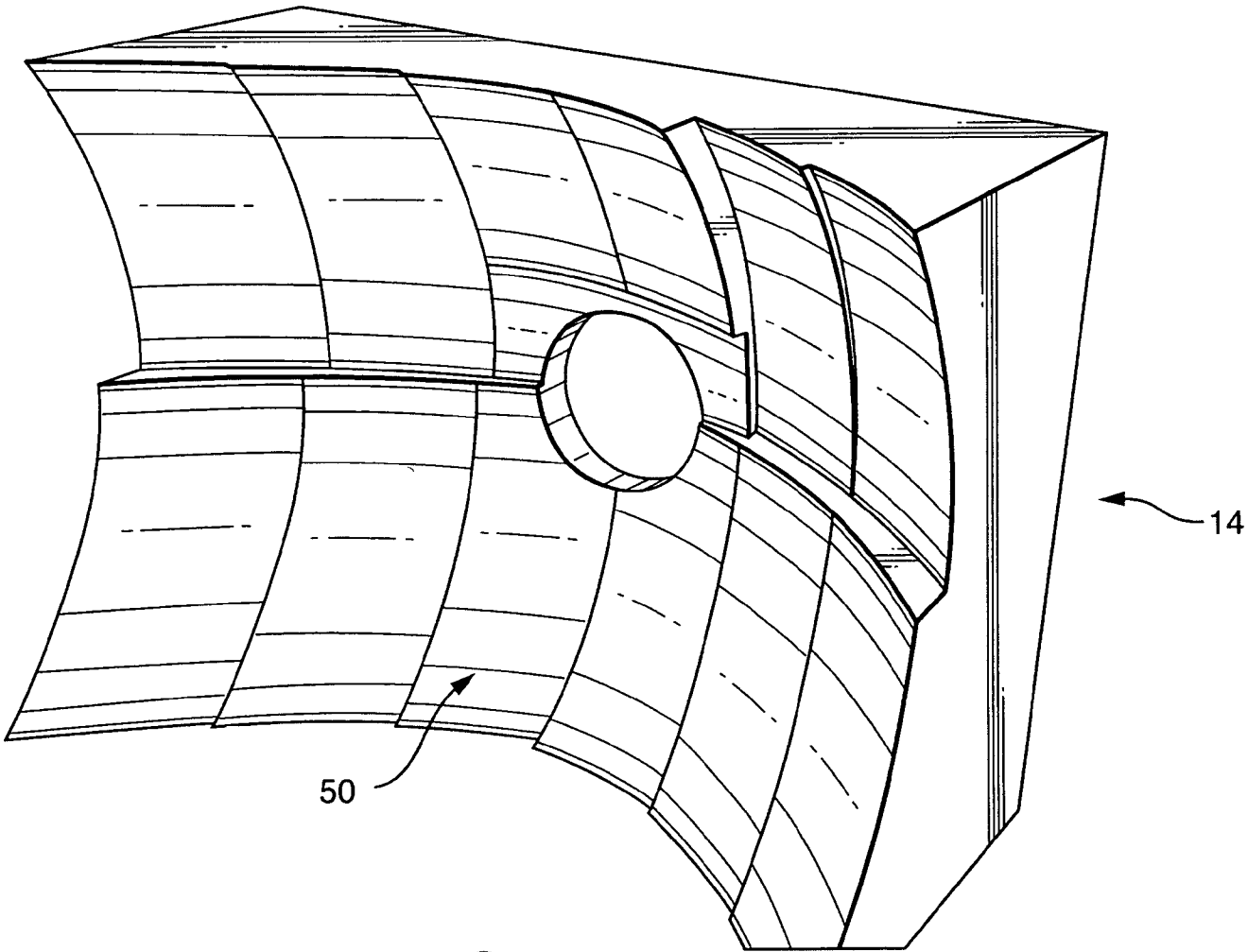
FIG. 7 shows a schematic front perspective view of preferred embodiment reflector for the automotive lamp.
Figure 8:
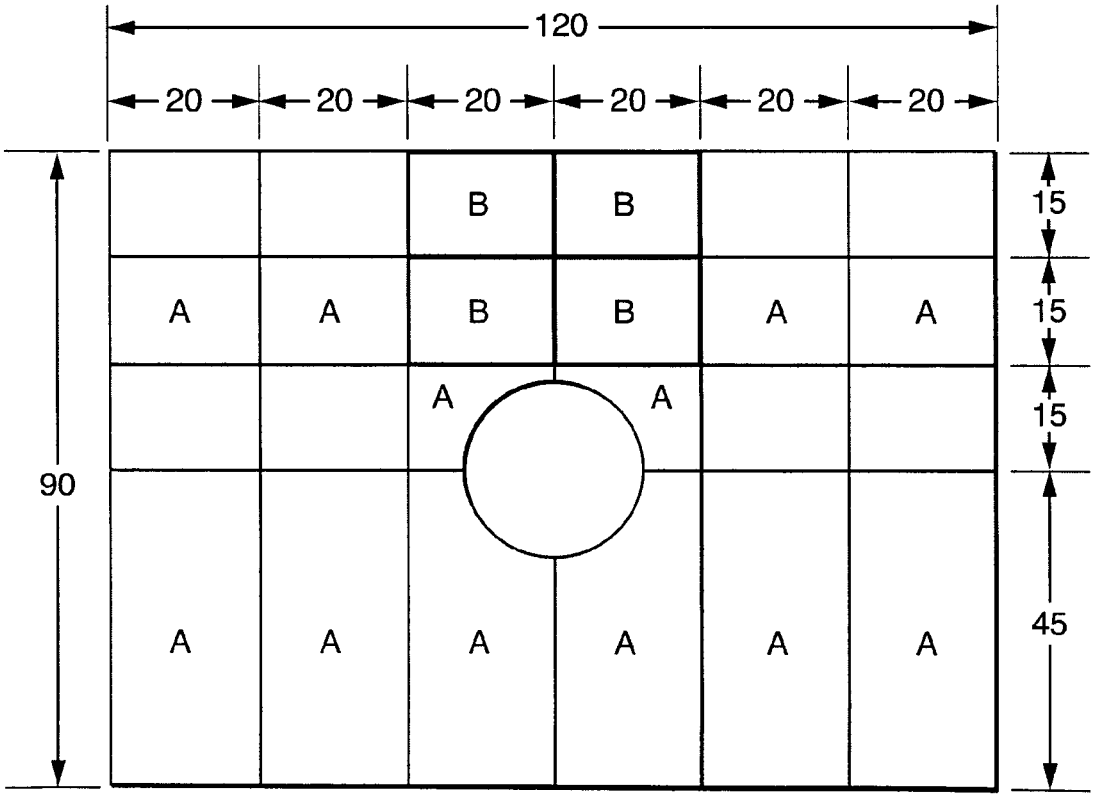
FIG. 8 shows a schematic front view of preferred embodiment reflector for the automotive lamp.
Figure 15:
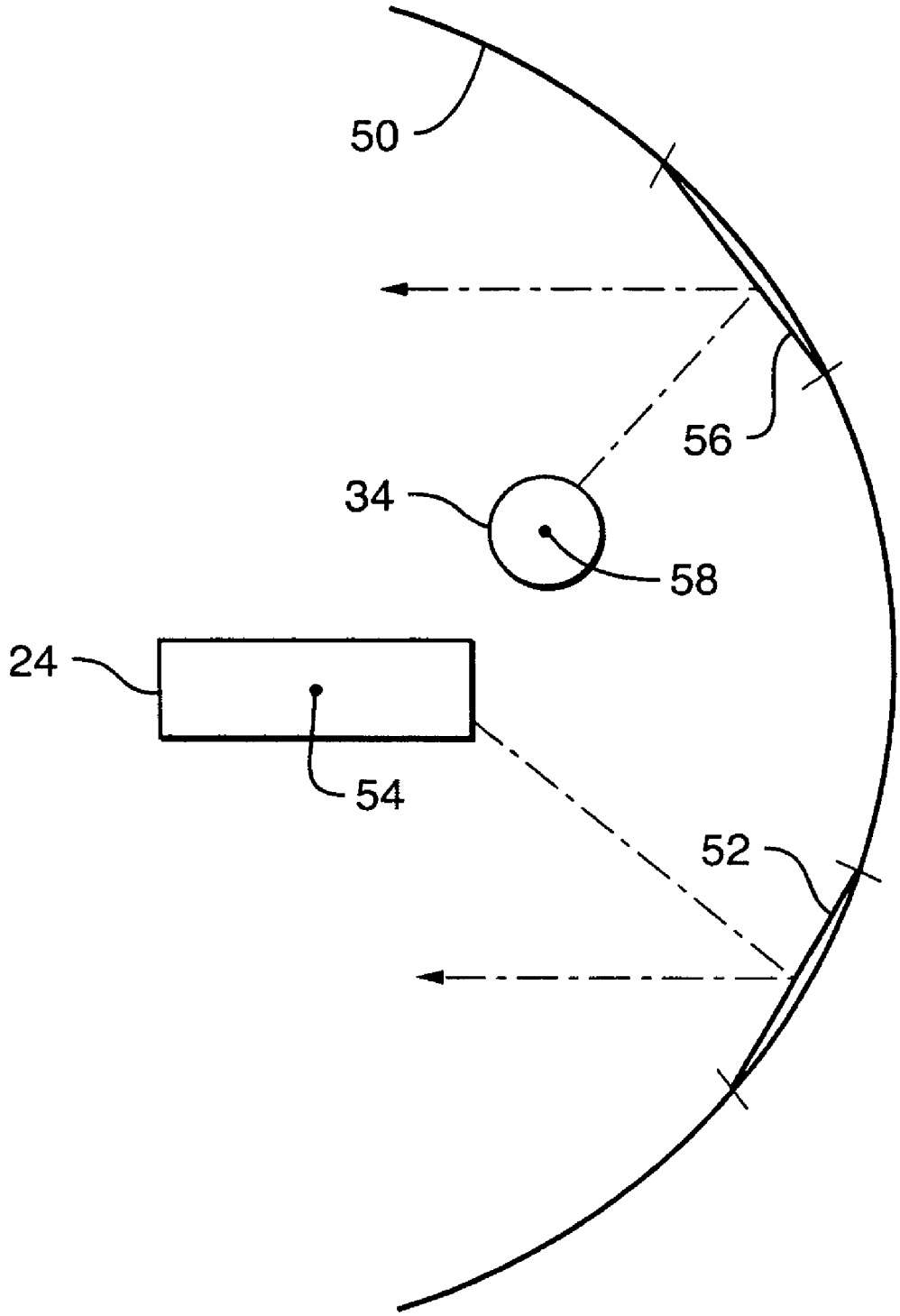
FIG. 15 shows a schematic cross-sectional view of the optical arrangement of the first filament, the second filament and the reflector.

FIG. 7 shows a schematic front perspective view of preferred embodiment reflector 14 for the automotive lamp. FIG. 8 shows a schematic front view of preferred embodiment reflector 14 for the automotive lamp. FIG. 15 shows a schematic cross-sectional view of the optical arrangement of the first filament 24, the second filament 34 and the reflector 14. The reflector 14 has a concave reflective surface 50, and has at least one reflective first section 52 defining at least one first focal point 54. The first focal point 54 is located adjacent to or within the volume (convex set) defined by the first filament 24. The reflective first section 52 is optically defined to project light from the first filament 24 in a forward direction as an automotive forward beam pattern. The reflector 14 has at least one reflective second section 56 defining at least one second focal point 58. The second focal point 58 is located adjacent to or within the volume (convex set) defined by the second filament 34. The reflective second section 56 is optically defined to project light from the second filament 34 in a direction that is generally horizontal and generally to a spot on one side (The vertical and horizontal spread from the center of the side directed spot is understood), which may be right or left of the forward direction when the lamp axis 18 is horizontal. In a preferred embodiment, the reflective second section 56 is rearward and above the coiled portion of the second filament 34 when the lamp axis 18 is horizontal and the second filament axis 36 is horizontal.

Figure 9:
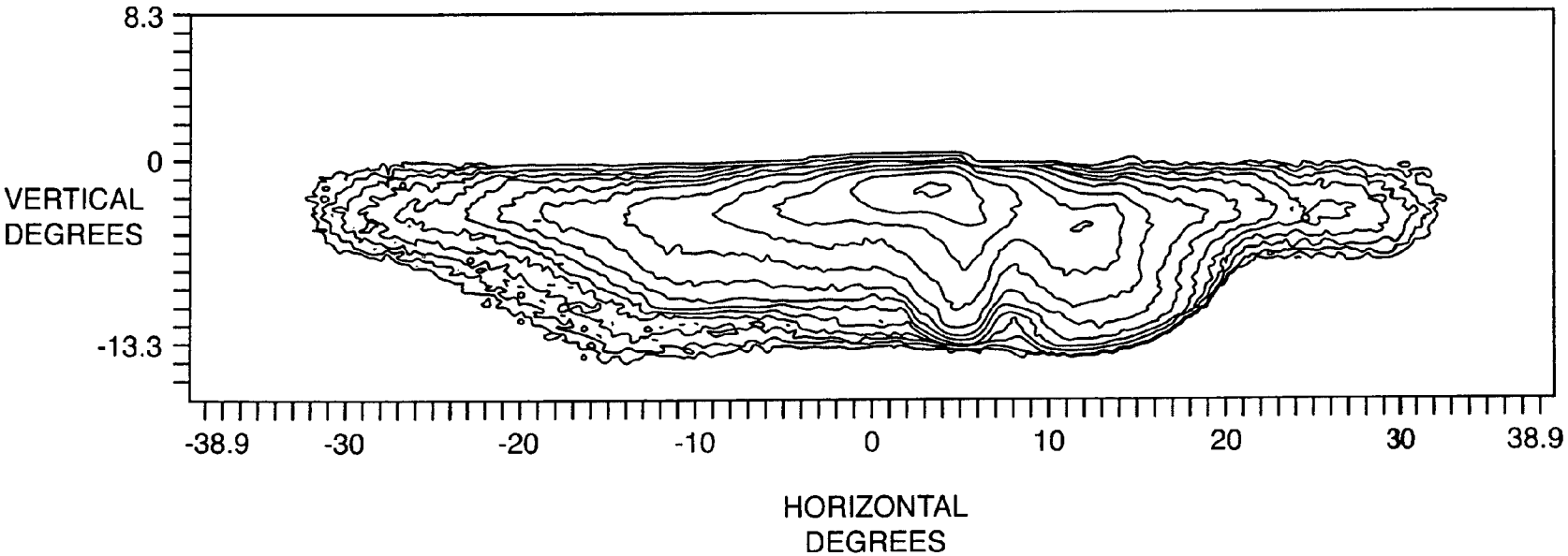
FIGS. 9 and 10 show vertical and horizontal views of a computer simulation of the low beam pattern.
Figure 10:
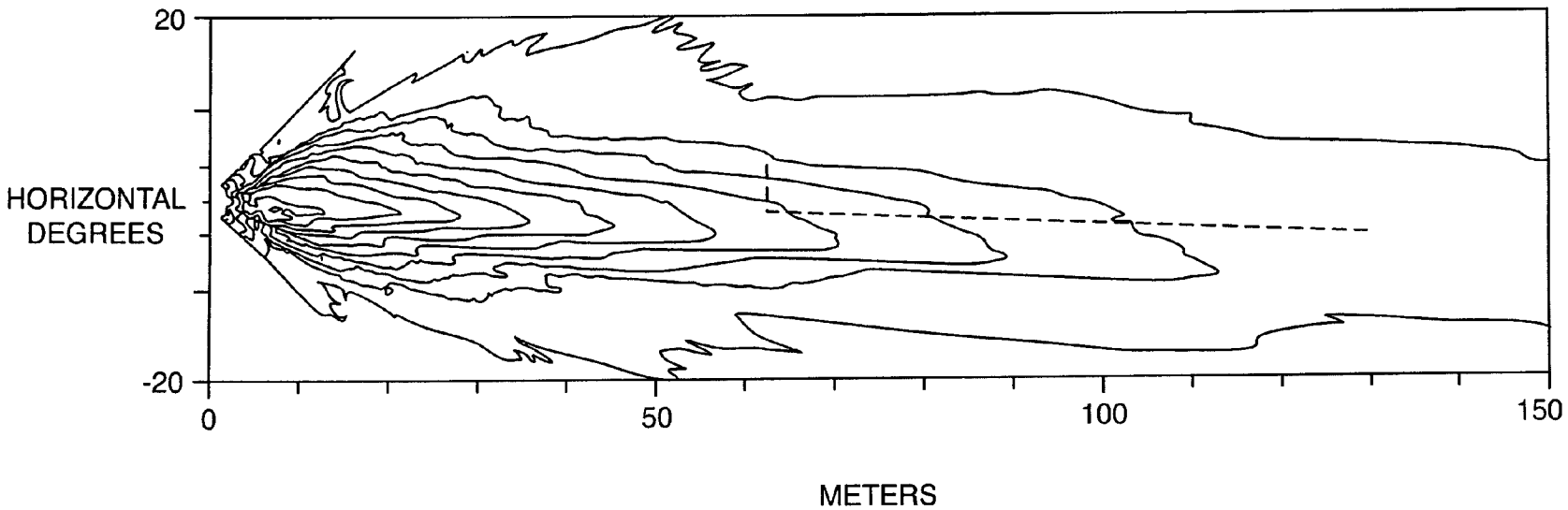
Figure 11:
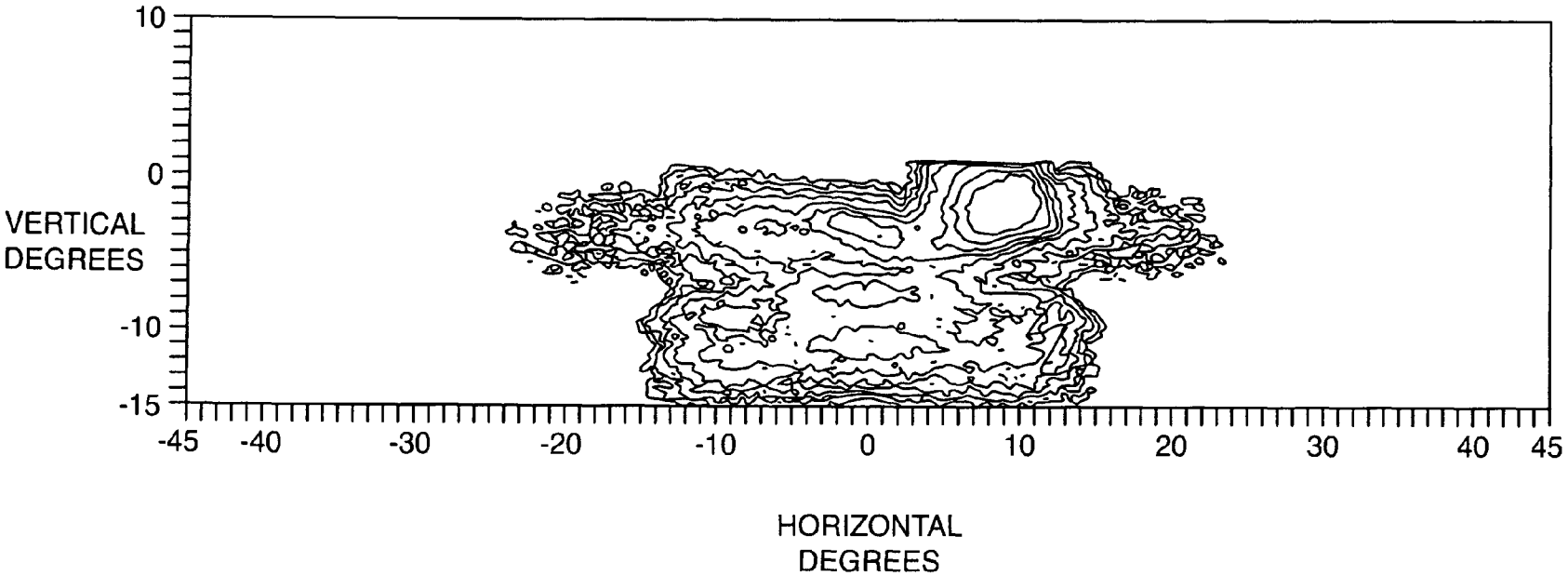
FIGS. 11 and 12 show vertical and horizontal views of a computer simulation of the right side beam projection pattern.
Figure 12:
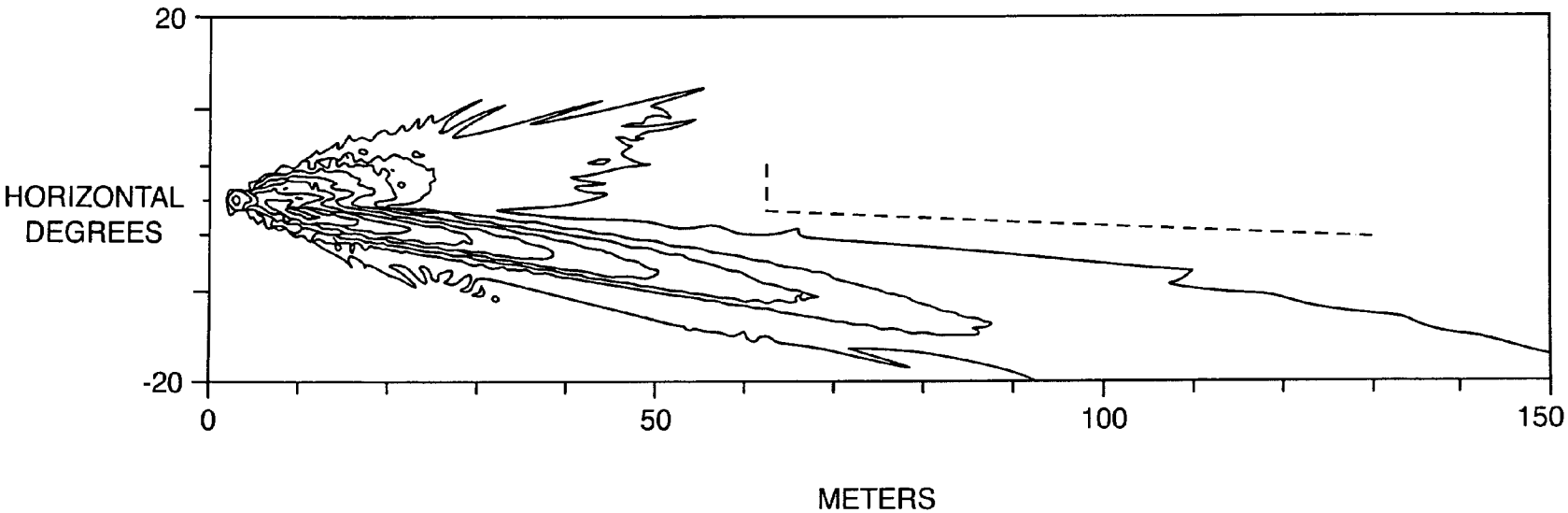
Figure 13:
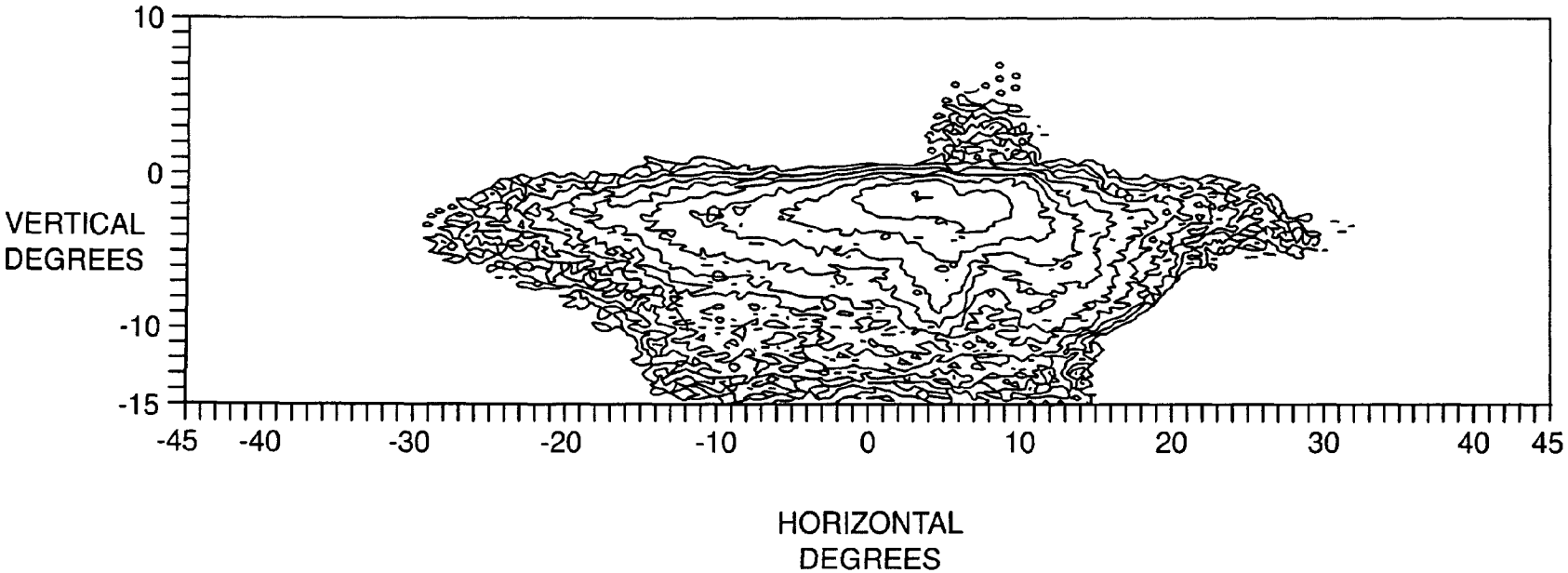
FIGS. 13 and 14 show vertical and horizontal views of a computer simulation of the low beam pattern combined with the right side beam projection pattern.
Figure 14:
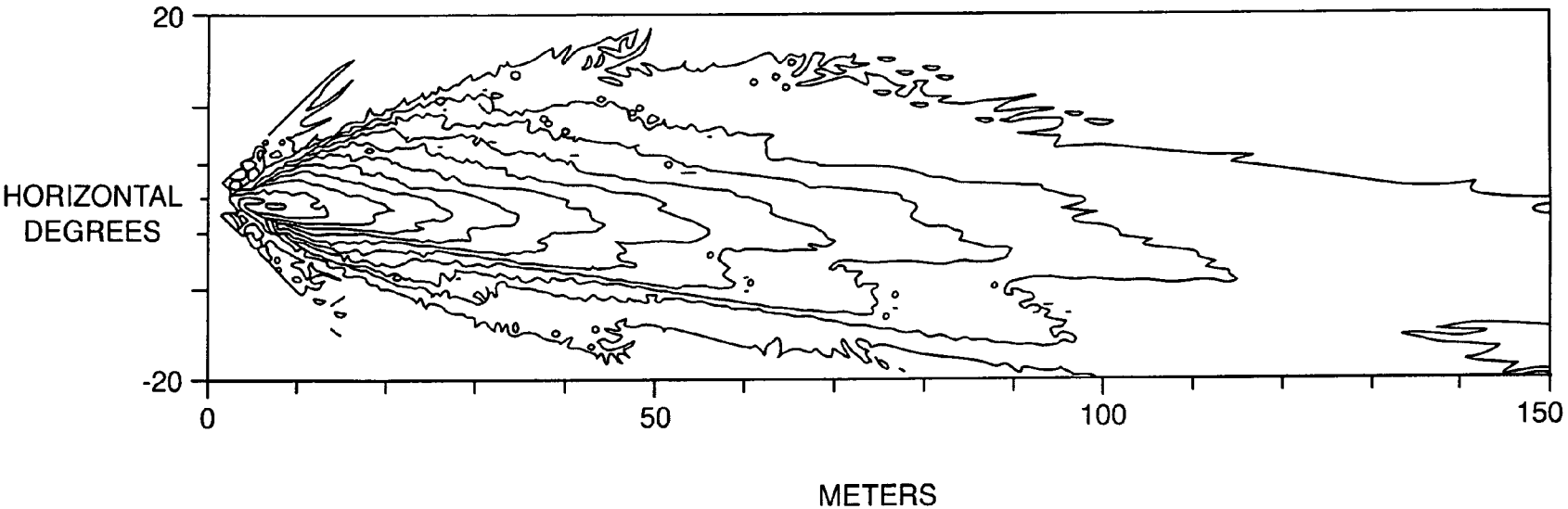

FIGS. 9 and 10 show vertical and horizontal views of a computer simulation of the low beam pattern from a single filament arranged like filament 24 and reflector 14. The low beam pattern shows good near and center line illumination with a trend to the right as is typical of right travel lane illumination requirements. The low beam pattern is provided during normal straight line driving. FIGS. 11 and 12 show vertical and horizontal views of a computer simulation of the right side beam projection pattern from a single filament arranged like filament 34 and reflector 14. A substantial side beam spike of about 20 degrees spread is angled to the right side to be centered at about 10 degrees from the center line. The right side spike is additionally directed to the road area (field) to be illuminated during certain right side turn conditions. The left side illumination of the beam is cast down as near field illumination. A similar left beam spike is produced when the lamp is used in a left side reflector. FIGS. 13 and 14 show vertical and horizontal views of a computer simulation of the low beam pattern combined with the right side beam projection pattern. This combined pattern shows the increased illumination on the right side of the pattern, as when a right turn is made.

The lamp capsule can be used on both right and left sides of a vehicle without rotation. This means the parasitic images are maintained in the same positions. The first filament 24 is offset from the center of the capsule (from the capsule center axis) so the ghost image from the capsule wall is above the first filament 24. The bottom side of the first filament then acts as a clean cut off. The lower projected image is inverted by the reflector 14 and appears on the top of the beam. If the second filament 34 is positioned on one side and creates the bending beam then the beam for the opposite side of the first filament 24 and requires for the opposite side requires a bulb that is rotated 180 degrees or less. This moves the ghost image to the opposite side of the first filament 24 and would create glare.

The solution is to have the second filament 34 mounted above the first filament 24 and centered horizontally.

The second filament 34 is oriented transverse to the bulb axis 18. The reflector facets about the bulb are then responsible for forming the bending beam, can create a horizontal images from the second filament 34 in the beam. The result is a sharper cut-off in the beam and allows better optical control of the light from the second filament 34.

The preferred first filament is 4.6 mm long, 1.66 mm in diameter and is sufficient, despite light lost to the black topped capsule end and to the base to provide a 1000 lumens final output. The preferred second filament is symmetrically transverse to, above and behind the first filament. The preferred second filament is 3 mm long, 2 mm in diameter and provides 500 lumens. The preferred reflector is divided into two sections. Most of the reflector is used for the low beam pattern production. The area in the horizontal center of the reflector and above the bulb capsule is used for the advanced forward lighting system bending beam production. A reflector prescription for the low beam on both sides of the vehicle. Only the advanced forward lighting facets have to be design separately for each side. Previous designs required the complex right and left beam patterns throughout the reflectors' optical design. The second filament is positioned above and behind the first filament. This ensures the second filament 34 images are centered by the low beam reflector portions are below the horizon and do not create glare. This is true also for the first filament images created by the advanced forward lighting reflector facets. When the second filament is energized the low beam first filament shades the second filament with respect to the low beam reflector elements, thereby reducing glare. Any light from the second filament reaching the low beam reflector elements is projected high down the road. Similarly light reflected from (missed by) the low beam or first filament from the second filament is projected.

While there have been shown and described what are at present considered to be the preferred embodiments of the invention, it will be apparent to those skilled in the art that various changes and modifications can be made herein without departing from the scope of the invention defined by the appended claims.

What is claimed is:

1. An automotive lamp and reflector assembly for low beam and advanced forward lighting system comprising:

a light transmissive envelope defining a lamp axis extending positively in a forward direction, and defining an enclosed volume; the envelope having a seal at a rear end of the envelope;

a first filament located in the enclosed volume and having a first filament axis extending generally in the lamp axis direction, the first filament axis being offset from the lamp axis on a first side of a plane through the lamp axis; and having a front leg at a forward end of the first filament, and a rear leg at a rear end of the first filament;

a second filament located in the enclosed volume and having a filament axis extending in a second filament direction substantially perpendicular to the lamp axis in a plane parallel to but offset from the lamp axis on a second side opposite the first side of the plane through the lamp axis, the second filament being positioned rearward of a rearwardmost portion of the first filament; and the second filament having a first leg at a first side end of the second filament, and a second leg at a second side end of the second filament;

a first electrically conductive lead extending through the seal and electrically coupled to and mechanically supporting the front leg of the first filament;

one or more second electrically conductive leads extending through the seal and electrically coupled to and mechanically supporting the rear leg of the first filament; and mechanically supporting the first side leg of the second filament;

a third electrically conductive lead extending through the seal and electrically coupled to and mechanically supporting the second side leg of the second filament; and a reflector having a concave reflective surface, having at least one reflective first section defining at least one first focal point located adjacent to or within a convex volume defined by the first filament, the first section optically defined to project light from the first filament in a forward direction as an automotive forward beam pattern; and having at least one reflective second section defining at least one second focal point located adjacent to or within a convex volume defined by the second filament, the second section optically defined to project light from the second filament in a direction that is horizontal and to a side of the forward direction when the lamp axis is horizontal.

2. The lamp assembly in claim 1, wherein the second filament has equal extensions with respect to the second filament axis on both sides of a vertical plane through the first filament axis when the lamp axis is horizontal and the second filament axis is horizontal.

3. The lamp assembly in claim 1, wherein the first electrically conductive lead parallels a side of the first filament.

4. The lamp assembly in claim 1, wherein the one or more second electrically conductive leads are rearward of the first filament and are below or rearward of the second filament when the lamp axis is horizontal and the second filament axis is horizontal.

5. The lamp assembly in claim 1, wherein the whole of the third electrically conductive lead is rearward of the first filament and is above and rearward of the second filament when the lamp axis is horizontal and the second filament axis is horizontal.

6. The lamp assembly in claim 1, wherein the lamp axis is tangent to a side of the first filament.

7. The lamp assembly in claim 1, wherein the lamp axis is tangent to a side of the second filament.

8. The lamp assembly in claim 1, wherein the reflective second section is rearward and above the second filament when the lamp axis is horizontal and the second filament axis is horizontal.

9. An automotive lamp for low beam and advanced forward lighting system comprising:

a light transmissive envelope defining a lamp axis extending positively in a forward direction and negatively in a rearward direction, and defining an enclosed volume; the envelope having a seal at a rear end of the envelope;

a first filament located in the enclosed volume and having a first filament axis extending generally in the lamp axis direction, the first filament axis being offset from the lamp axis on a first side of a plane through the lamp axis; and having front leg at a forward end of the first filament, and a rear leg at a rear end of the first filament;

a second filament located in the enclosed volume and having a second filament axis extending in a second filament direction substantially perpendicular to the lamp axis in a plane parallel to but offset from the lamp axis on a second side opposite the first side of the plane through the lamp axis, the second filament being positioned rearward of a rearwardmost portion of the first filament; and the second filament having a first leg at a first side end of the second filament, and a second leg at a second side end of the second filament;

a first electrically conductive lead extending through the seal and electrically coupled to and mechanically supporting the front leg of the first filament;

one or more second electrically conductive leads extending through the seal and electrically coupled to and mechanically supporting the rear leg of the first filament; and mechanically supporting the first side leg of the second filament; and a third electrically conductive lead extending through the seal and electrically coupled to and mechanically supporting the second side leg of the second filament.

10. The lamp in claim 9, wherein the second filament has equal extensions with respect to the second filament axis on both sides of a vertical plane through the first filament axis when the lamp axis is horizontal and the second filament axis is horizontal.

11. The lamp in claim 9, wherein the second electrically conductive lead is the same lead as the third electrically conductive lead.

12. The lamp in claim 9, wherein the first electrically conductive lead parallels a side of the first filament.

13. The lamp in claim 9, wherein the whole of the second electrically conductive lead is rearward of the first filament and is below or rearward of the second filament when the lamp axis is horizontal and the second filament axis is horizontal.

14. The lamp in claim 9, wherein the whole of the third electrically conductive lead is rearward of the first filament and is above or rearward of the second filament when the lamp axis is horizontal and the second filament axis is horizontal.

15. The lamp in claim 9, wherein the lamp axis is tangent to a side of the first filament.

16. The lamp in claim 9, wherein the lamp axis is tangent to a side of the second filament.

17. An automotive lamp for low beam and advanced forward lighting system comprising:

a light transmissive envelope defining a lamp axis extending positively in a forward direction and negatively in a rearward direction, and defining an enclosed volume; the envelope having a seal at a rear end of the envelope;

a first filament located in the enclosed volume and having a first filament axis extending generally in the lamp axis direction; and having front leg at a forward end of the first filament, and a rear leg at a rear end of the first filament;

a second filament located in the enclosed volume and extending in a second filament direction substantially perpendicular to the lamp axis in a plane parallel to but offset from the lamp axis, the second filament being positioned rearward of a rearwardmost portion of the first filament; and the second filament having a first leg at a first side end of the second filament, and a second leg at a second side end of the second filament;

a first electrically conductive lead extending through the seal and electrically coupled to and mechanically supporting the front leg of the first filament;

one or more second electrically conductive leads extending through the seal and electrically coupled to and mechanically supporting the rear leg of the first filament; and mechanically supporting the first side leg of the second filament; and a third electrically conductive lead extending through the seal and electrically coupled to and mechanically supporting the second side leg of the second filament, wherein the second electrically conductive lead is the same lead as the third electrically conductive lead.

18. An automotive lamp for low beam and advanced forward lighting system comprising:

a light transmissive envelope defining a lamp axis extending positively in a forward direction, and defining an enclosed volume; the envelope having a seal at a rear end of the envelope;

a first filament located in the enclosed volume and having a first filament axis extending generally in the lamp axis direction; and having front leg at a forward end of the first filament, and a rear leg at a rear end of the first filament;

a second filament located in the enclosed volume and extending in a second filament direction substantially perpendicular to the lamp axis in a plane parallel to but offset from the lamp axis, the second filament being positioned rearward of a rearwardmost portion of the first filament; and the second filament having a first leg at a first side end of the second filament, and a second leg at a second side end of the second filament;

a first electrically conductive lead extending through the seal and electrically coupled to and mechanically supporting the front leg of the first filament;

one or more second electrically conductive leads extending through the seal and electrically coupled to and mechanically supporting the rear leg of the first filament; and mechanically supporting the first side leg of the second filament; and a third electrically conductive lead extending through the seal and electrically coupled to and mechanically supporting the second side leg of the second filament;

wherein the lamp axis is tangent to a side of the second filament (34).

19. An assembly having the lamp in claim 18 in combination, further comprising:

a reflector having a concave reflective surface, having at least one reflective first section defining at least one first focal point located adjacent to or within a convex volume defined by the first filament, the first section optically defined to project light from the first filament in a forward direction as an automotive forward beam pattern; and having at least one reflective second section defining at least one second focal point located adjacent to or within a convex volume defined by the second filament, the second section optically defined to project light from the second filament in a direction that is horizontal and to a side of the forward direction when the lamp axis is horizontal.

20. An automotive lamp for low beam and advanced forward lighting system comprising:

a light transmissive envelope defining a lamp axis extending positively in a forward direction and negatively in a rearward direction, and defining an enclosed volume; the envelope having a seal at a rear end of the envelope;

a first filament located in the enclosed volume and having a first filament axis extending generally in the lamp axis direction; and having front leg at a forward end of the first filament, and a rear leg at a rear end of the first filament;

a second filament located in the enclosed volume and extending in a second filament direction substantially perpendicular to the lamp axis in a plane parallel to but offset from the lamp axis, the second filament being positioned rearward of a rearwardmost portion of the first filament; and the second filament having a first leg at a first side end of the second filament, and a second leg at a second side end of the second filament;

a first electrically conductive lead extending through the seal and electrically coupled to and mechanically supporting the front leg of the first filament;

one or more second electrically conductive leads extending through the seal and electrically coupled to and mechanically supporting the rear leg of the first filament; and mechanically supporting the first side leg of the second filament; and a third electrically conductive lead extending through the seal and electrically coupled to and mechanically supporting the second side leg of the second filament;

wherein a line of sight exists between the first filament (24) and the second filament (34).

21. An assembly having the lamp in claim 20 in combination, further comprising:

a reflector having a concave reflective surface, having at least one reflective first section defining at least one first focal point located adjacent to or within a convex volume defined by the first filament, the first section optically defined to project light from the first filament in a forward direction as an automotive forward beam pattern; and having at least one reflective second section defining at least one second focal point located adjacent to or within a convex volume defined by the second filament, the second section optically defined to project light from the second filament in a direction that is horizontal and to a side of the forward direction when the lamp axis is horizontal.

22. An automotive lamp for low beam and advanced forward lighting system comprising:

a light transmissive envelope defining a lamp axis extending positively in a forward direction and negatively in a rearward direction, and defining an enclosed volume; the envelope having a seal at a rear end of the envelope;

a first filament located in the enclosed volume and having a first filament axis extending generally in the lamp axis direction; and having front leg at a forward end of the first filament, and a rear leg at a rear end of the first filament;

a second filament located in the enclosed volume and extending in a second filament direction substantially perpendicular to the lamp axis in a plane parallel to but offset from the lamp axis, the second filament being positioned rearward of a rearwardmost portion of the first filament; and the second filament having a first leg at a first side end of the second filament, and a second leg at a second side end of the second filament;

a first electrically conductive lead extending through the seal and electrically coupled to and mechanically supporting the front leg of the first filament;

one or more second electrically conductive leads extending through the seal and electrically coupled to and mechanically supporting the rear leg of the first filament; and mechanically supporting the first side leg of the second filament; and a third electrically conductive lead extending through the seal and electrically coupled to and mechanically supporting the second side leg of the second filament;

wherein the whole of the third electrically conductive lead is rearward of the first filament and is above and rearward of the second filament when the lamp axis is horizontal and the second filament axis is horizontal.

23. An assembly having the lamp in claim 22 in combination, further comprising:

a reflector having a concave reflective surface, having at least one reflective first section defining at least one first focal point located adjacent to or within a convex volume defined by the first filament, the first section optically defined to project light from the first filament in a forward direction as an automotive forward beam pattern; and having at least one reflective second section defining at least one second focal point located adjacent to or within a convex volume defined by the second filament, the second section optically defined to project light from the second filament in a direction that is horizontal and to a side of the forward direction when the lamp axis is horizontal.

* * * * *